United States Patent [19]

Sykes

[11] 4,211,100

[45] Jul. 8, 1980

[54] WIRE SPRING FORMING MACHINE

[76] Inventor: Willard D. Sykes, 5613 152nd St. North, Hugo, Minn. 55038

[21] Appl. No.: 963,192

[22] Filed: Nov. 24, 1978

[51] Int. Cl.[2] ..... B21F 3/02

[52] U.S. Cl. ..... 72/131; 72/137

[58] Field of Search ..... 72/131, 135, 137, 138

[56] References Cited

U.S. PATENT DOCUMENTS

| | | | |
|---|---|---|---|
| 2,077,243 | 4/1937 | Leal | 72/138 |
| 2,149,941 | 3/1939 | Prentice | 72/131 |
| 2,779,860 | 1/1957 | Conrad | 72/137 |
| 3,757,552 | 9/1973 | Ritter et al. | 72/131 |
| 4,030,327 | 6/1977 | Collins et al. | 72/131 |
| 4,112,721 | 9/1978 | Takase et al. | 72/138 |

*Primary Examiner*—Lowell A. Larson
*Attorney, Agent, or Firm*—Leo Gregory

[57] ABSTRACT

This invention relates to a wire spring forming machine which consists of structure comprising endless wire feeding rollers which move continuously in a wire feeding direction and feed wire without interruption except for the cutting of each spring as it is formed and this is a substantial improvement over the prior art or general use made of segmental or rack gears which require a reversal of movement to a start position of the gears used for each increment of wire fed for each spring formed and which represents a loss of time during which the structure herein would be forming another spring.

9 Claims, 28 Drawing Figures

10
23
50
11
ED
75
88
203
210
211
70
200
201
206
208
15
85
90
176
31
33
100
26
150
116
118
120
32
152
34
35
95
111
102
110
121
115
124
123
30
28
42
14a
146
14
87
122
EA
36
145
77
80
38
W
39

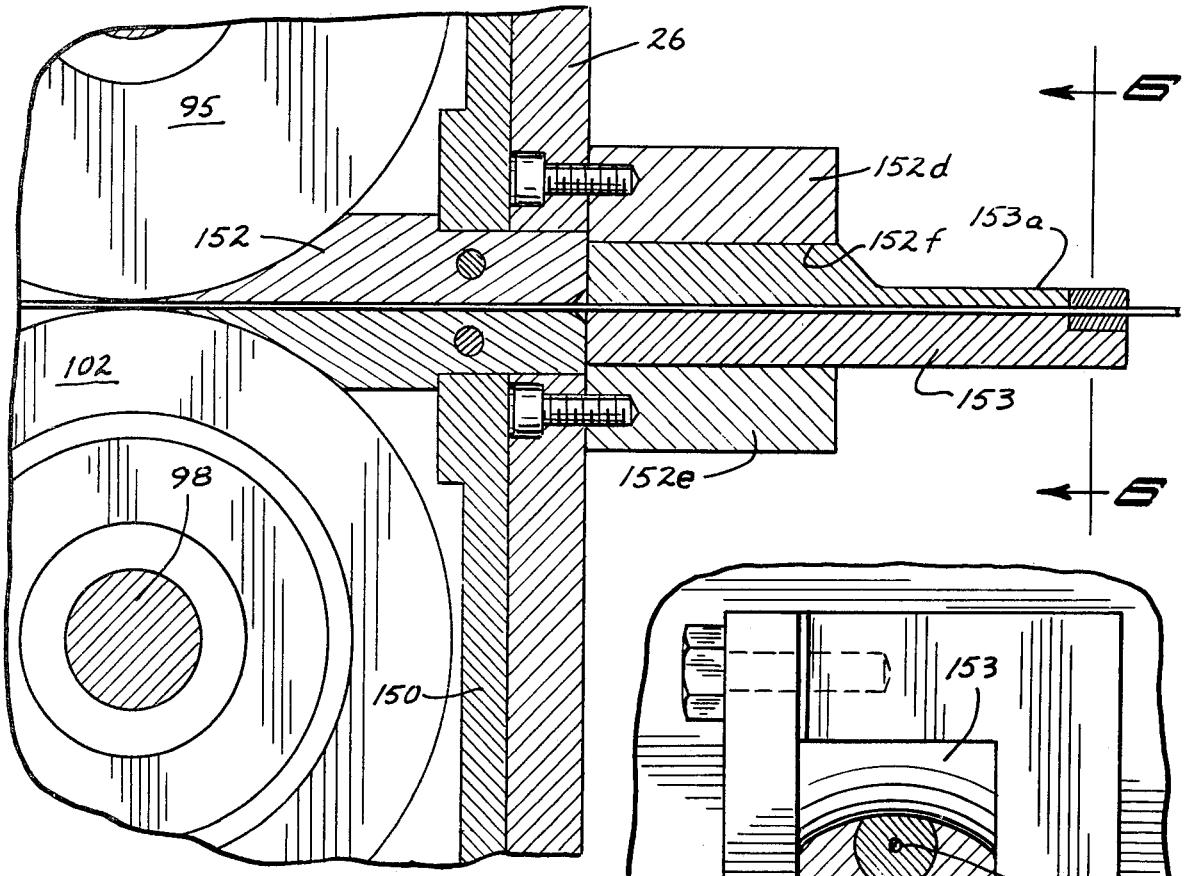
FIG. 5
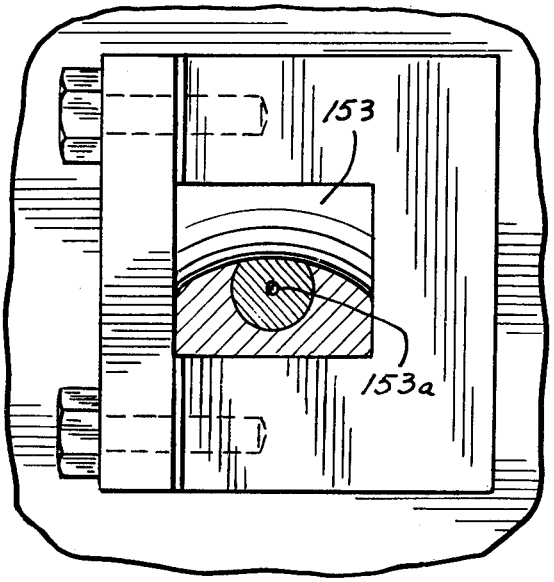
FIG. 6
FIG. 5A
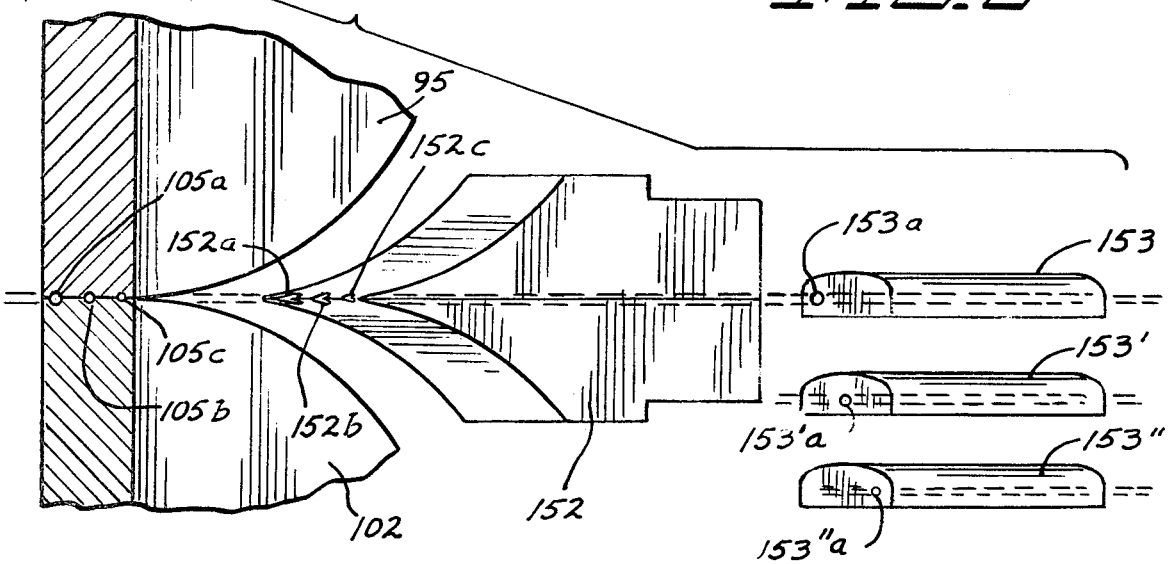

WIRE SPRING FORMING MACHINE

BACKGROUND OF THE INVENTION

1. Field of the Invention

This invention relates to wire spring forming machines.

2. Description of the Prior Art

Known in the prior art as relating to the structure herein are the following U.S. Patents:

a. U.S. Pat. No. 3,351,101 to Halverson et al requires the use of an arbor to coil a spring and can coil only in a left hand or right hand direction. The spring coiled is wound about an arbor from which the spring is required to be unwound in a reverse coiling action for release from the arbor.

The machine herein feeds wire continuously in a wire feeding direction, the spring coil being formed free of being wound and retained about an arbor or without the use of an arbor and each spring upon being fully formed is cut off from the wire feed stock without any reversal action. During the time that Halverson is releasing a spring from an arbor by a reverse coiling action, the machine herein forms another spring.

b. U.S. Pat. No. 3,025,889 to Clay assigned to Baird Corporation. Here two feed rolls are used with a groove formed on each roll requiring a change in feed rolls to accommodate changes in wire size and in addition liner sections and deflecting tools have to be changed.

The machine herein is adapted to receive a range of wire sizes and the only change required is that of a simple replacement of a quill having the appropriate size of passage therethrough to align with a corresponding size passage in the feeding apparatus of the machine.

c. U.S. Pat. Nos. 3,025,889, 3,025,890 and 3,025,891 to Clay assigned to Baird Corporation disclose the use of a segmental gear which provides limited forward feeding motion to the extent of the gear which is intended to feed the length of wire required for a given spring and the gear is then reversed to its starting position for the next wire feeding cycle and thus there is no continuous forward feeding action of the wire feeding elements as is the case with the machine described herein.

During the interval of time in which the segmental gears in the above indicated patents are reversed to a starting position, the machine herein will produce another spring and thus have on the order of twice the production output in producing wire springs as with the case of the above described patents.

SUMMARY OF THE INVENTION

The invention herein relates to a wire spring forming machine arranged and constructed to provide a wire spring forming operation for continuous movement of the wire feeding apparatus in a wire feeding direction.

The structure herein represents a substantial improvement over prior art machines which in general embody the use of segmental gear wire feeding arrangements wherein the length of the gear determines the limit of wire fed for each spring formed and requires a reversal action of the gear to its starting position for each spring formed. Moreover, the gears involved require change and adjustment for each spring formed which requires a different length of wire to be fed and the set up time for each change is time consuming and represents a significant labor cost item in addition to the investment in an inventory of gears.

It is an object of this invention herein to embody the use of a continuous forward wire feeding apparatus which requires no reverse movement of any part thereof in any phase of the wire feeding operation.

It is a further object of this invention herein to provide an apparatus which does not embody the use of gears such as rack or segmental gears for wire feeding purposes.

It is another object of the invention herein to provide a sensing device to measure the length of wire being fed for a given spring relative to pre-set arrangement therein with means actuated thereby to cut off each spring as it is completed from the wire stock being fed.

It is also an object of the invention herein to provide a wire feeding apparatus arranged and constructed to have a plurality of passages to receive various sizes of wire having in connection therewith an appropriate quill to accommodate the size of wire being fed, a quill being provided for each of the sizes which may be fed by said feeding apparatus and to be readily exchanged for another quill for a particular different size of wire to be fed which quill will have the passage therethrough in alignment with a like sized passage in the wire feeding apparatus.

It is further an object of the invention herein to provide wire feeding elements which comprise forwardly moving endless wire feeding rollers in which the forward feeding motion of the wire stock being fed is sensed electronically and at pre-set intervals representing the length of wire being fed for each spring being formed, the wire feeding elements are disengaged from driving engagement with said wire stock for the interval of time required to cut free a spring which is formed.

It is more specifically an object of the invention herein to provide a wire spring forming machine embodying the use of endless wire feeding rollers having in connection therewith an electronic sensor acting as a monitor which senses the length of wire fed for each spring formed and interrupts the forward feeding action of the wire stock sufficiently to actuate a wire cutting member to cut free the spring formed and the wire forming elements are sequentially moved into operating position by cam members particularly designed to provide a desired form of a spring.

These and other objects and advantages of the invention will be set forth in the following description made in connection with the accompanying drawings in which like reference characters refer to similar parts throughout the several views.

DESCRIPTION OF THE DRAWINGS

FIG. 1 is a view in front elevation;

FIG. 5 is a fragmentary view in vertical section showing a detail of wire feeding structure on an enlarged scale;

FIG. 5A is an expanded fragmentary view in perspective showing the relationship of wire feeding elements;

FIG. 6 is a view in vertical section taken on line 6—6 of FIG. 5 as indicated;

FIG. 19 is a view in vertical cross-section taken on line 19—19 of FIG. 18 as indicated;

DESCRIPTION OF A PREFERRED EMBODIMENT

Figure 7:
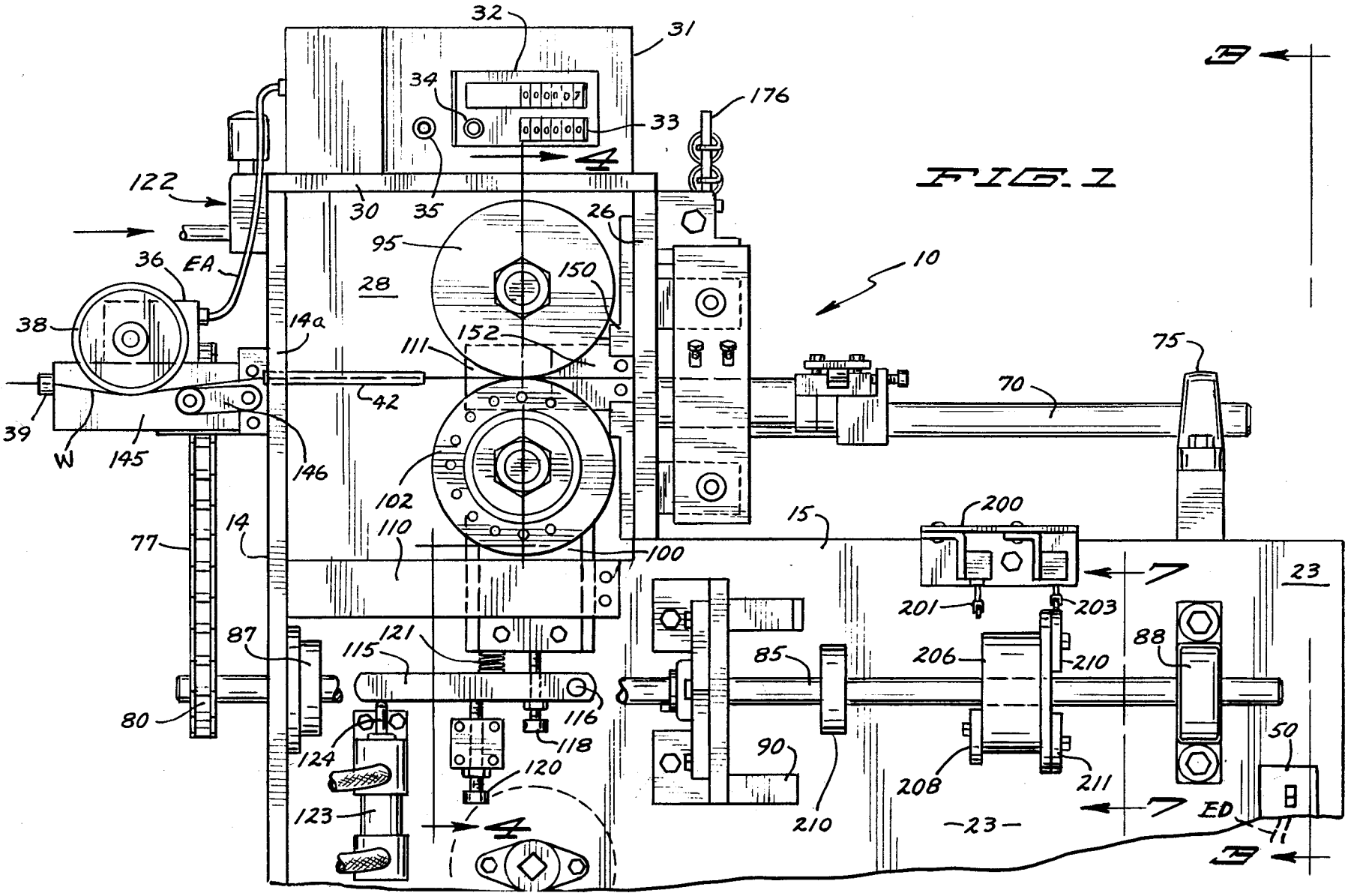
FIGS. 7–10 are views partially schematic showing the operative positions in stages of structural members which influence the wire forming elements.

The invention herein relates to a wire spring forming machine arranged and constructed to be either hydraulically or mechanically operated.

The machine will first be described as a hydraulically operated machine.

Referring to the drawings and particularly to FIGS. 1–6 and 18, the machine generally is indicated by the reference numeral 10.

Figure 3:
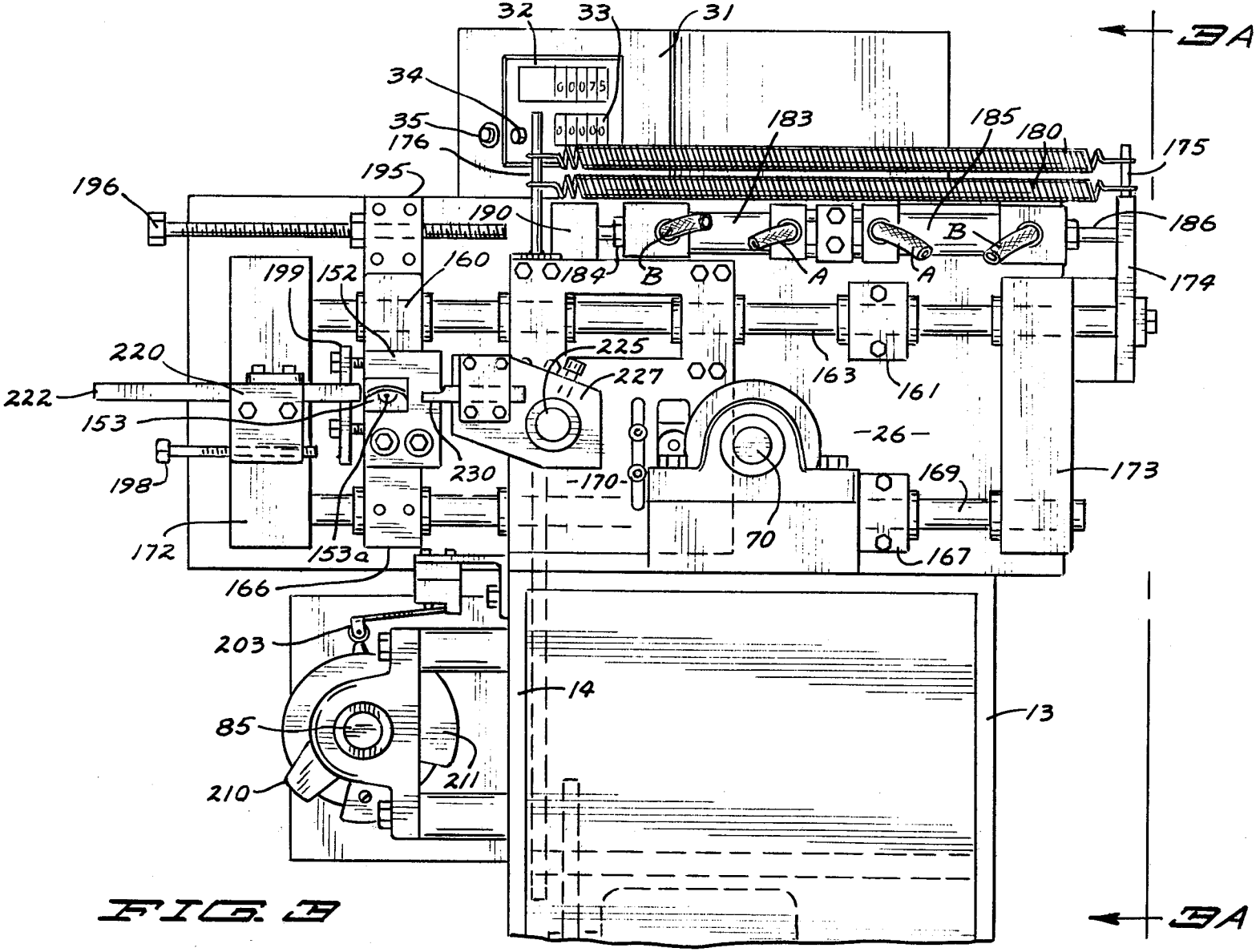
FIG. 3 is a view in side elevation taken on line 3—3 of FIG. 1 as indicated.
Figure 3A:
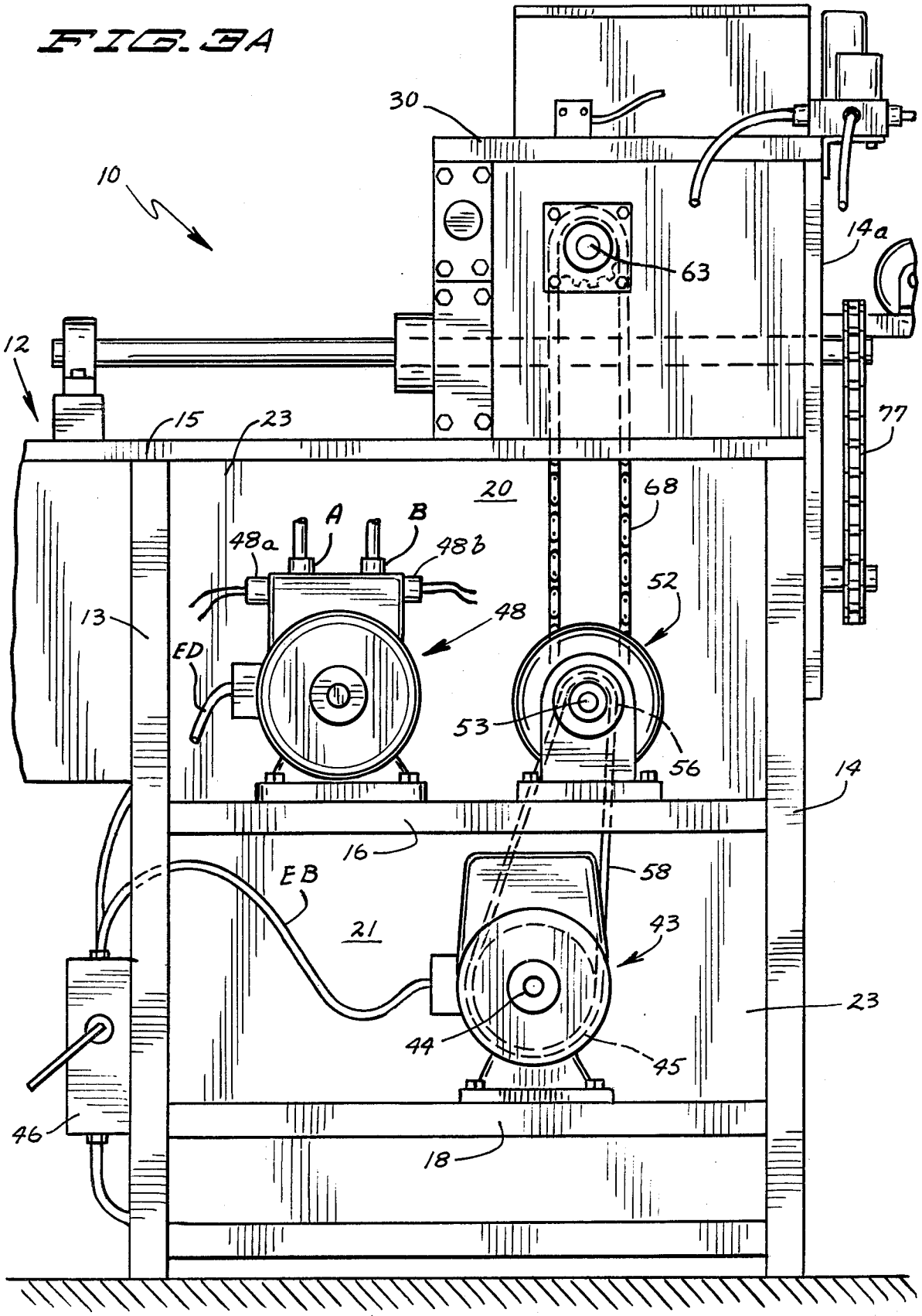
FIG. 3A is a view in rear elevation taken on line 3A—3A of FIG. 3 as indicated with some portions being broken away.

Supporting said machine and shown in rear view thereof in FIG. 3A is a base or supporting cabinet 12 having side walls 13 and 14, a top wall 15 and a pair of shelves 16 and 18 respectively spaced below said top wall forming open back chambers 20 and 21 and a front wall 23 of said cabinet enclosing the front sides of said chambers.

Upstanding from said top wall 15 spaced inwardly of the end wall 14 is a wall 26 and parallel thereto spaced therefrom is an upward extension 14*a* of the side wall 14. Extending between said walls 26 and 14*a* are spaced vertical wall members 28 and 29 overlying which is a top wall member 30 forming a shelf.

Seated on said shelf 30 is a control means 31 monitoring the length of wire fed to form a spring and in the present embodiment this is shown as a conventional incremental digital electronic count control device having a panel 32 having, a manual reset button 34 and a plurality of count setting operating buttons 33 therein. Hereinafter described will be the circuitry which includes said control device. A button switch 35 connected to an appropriate electric current supply will energize said control device.

Said device 31 by means of the operating buttons 33 will be set to control the feeding of predetermined lengths of wire W for each spring to be formed. Said device by means of the line EA is in the circuit with a conventional encoder 36 which measures the length of wire W being fed by means of a wheel 38 carried thereby. The wire from a supply is fed through a block 39 passing under said wheel 38 through a wire guide 42. Said wire sufficiently engages the bottom rim portion of said wheel 38 to rotate the same. The wheel 38 may have any desired diameter. The control device 31 registers impulses received from the encoder and the encoder is set for purposes herein to provide one impulse for each inch of wire which moves said wheel 38. When a predetermined number of inches are fed sufficient to form a given spring, such as 7 inches, the device 31 as pre-set that upon sensing each increment of 7 inches, it will repeat or cycle itself. Thus, when 7 inches of wire are fed, said control device will stop the wire feeding operation momentarily, cause the spring formed to be cut off of the wire stock from which it is fed and thereafter be reset, as will be described, for the next cyclical count of 7 inches of wire and thus the operation of forming individual springs repeats itself. The internal wiring of the device 31 to perform the functions described is known in the art and the wire cutting operation will be further described.

Figure 2:
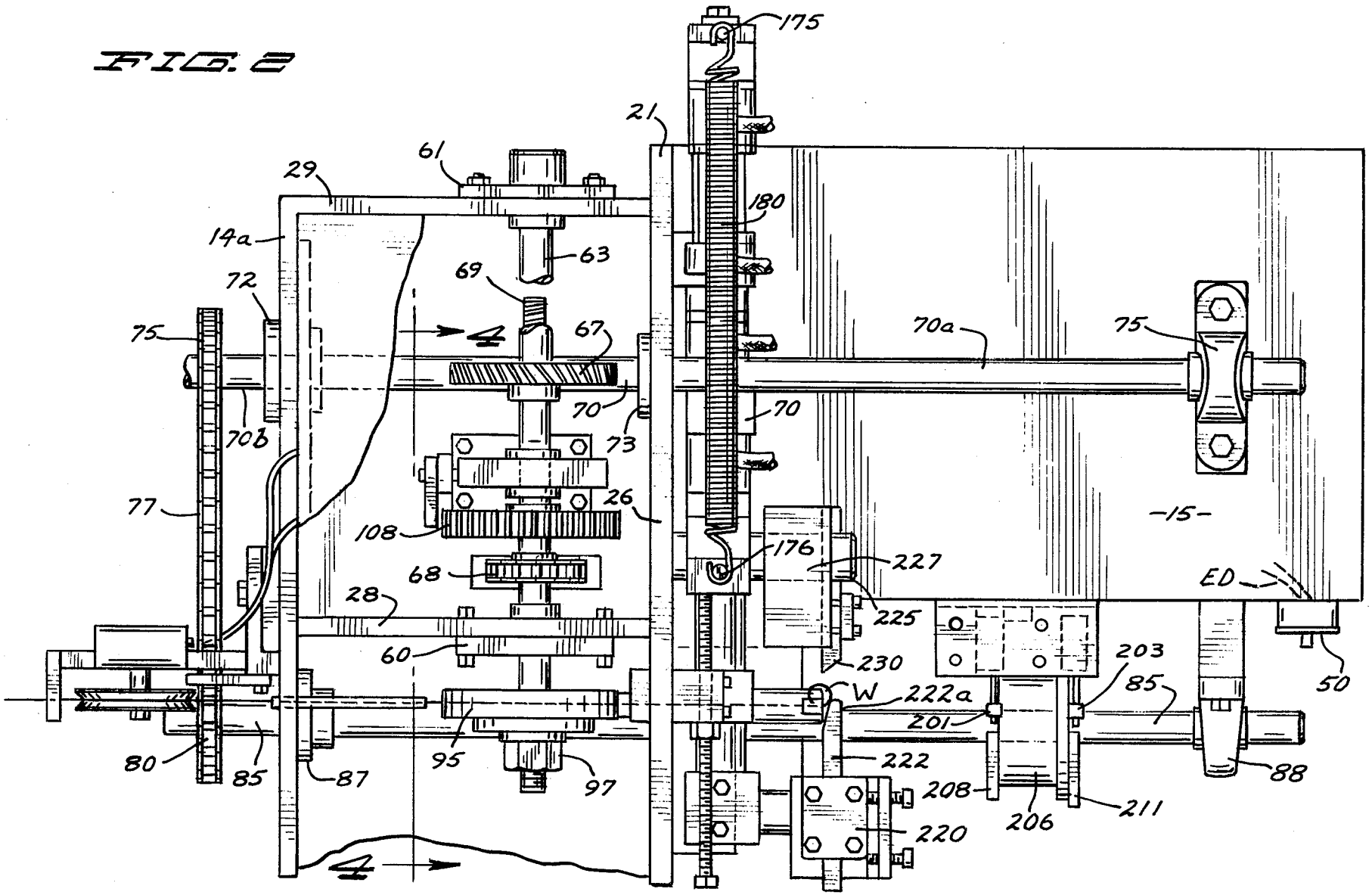
FIG. 2 is a top plan view with a portion broken away.

Referring now more specifically to FIGS. 2, and 3A, supported on said shelf 18 is a power means 43 shown here as a motor indicated here as being a vari-speed motor and the same is in circuit with a switch 46 by a line EB which switch in turn has a line running to an appropriate electric power source. The drive shaft 44 of said motor has mounted thereon a sprocket wheel 45.

Supported on the shelf 16 is a tool operating means 48 shown here as a hydraulic pump and motor within a common housing and referred to hereafter as a hydraulic pump and is in circuit with a switch 50 by means of a line ED and said switch communicates with an electric power source. Said hydraulic pump has solenoids 48*a* and 48*b* respectively controlling the ports A and B of said pump.

Positioned above the motor 43 on the shelf 16 is a gear reduction train 52 comprising a suitably mounted shaft 53 carrying thereon sprocket wheels 56 and 57. A sprocket chain 58 passes over the sprocket wheels 45 and 56.

Extending between and through the upper portions of the walls 28 and 29 and being suitably journaled therein by bearing members 60 and 61 is a shaft 63.

Carried on said shaft 63 at the inner side of said wall 28 is a sprocket wheel 66 having a sprocket chain 68 pass thereover and over the sprocket wheel 57 carried on said shaft 63.

Also carried on said shaft 63 is a helical gear 67 to form a right angled drive means with a corresponding helical gear 69 carried by a shaft 70 which is journaled in bearing plates 72 and 73 carried by the walls 14*a* and 26 and extends at right angles to said shaft 63 to have its extended end portion 70*a* journaled in an upstanding bearing mount or support 75 secured adjacent the remote end portion of the top wall 15.

The end portion 70*b* of said shaft 70 extends outwardly of said wall 14*a* and carries thereon a sprocket wheel 75 and has a sprocket chain 77 pass thereover and over a sprocket wheel 80 which is mounted on a shaft 85 outwardly of said wall 14, said shaft extends through the side wall 14 and across the front wall 23 and is shown journaled in bearing members 87 and 88 respectively carried by said side wall and said front wall.

Mounted on the portion of said shaft 63 extending forwardly of the wall 28 is a wire feeding wheel or roller member 95 and the same may be secured as indicated by a lock nut 97 onto the threaded end portion of said shaft.

Carried on a stub shaft 98 extending through the wall 28 and being suitably journaled in bearings 99 carried in a way or slide member 100 is a second wire feeding wheel or roller member 102 positioned below said first mentioned wire feeding wheel and as shall be described, the same has releasable wire feeding engagement with said first mentioned wire feeding wheel. Said wheels or rollers 95 and 102 drive or feed wire passing therebetween when in wire feeding engagement with each other. Said wire feeding wheel 102 has a plurality of transversely spaced annular grooves 105 thereabout in semi-circular cross section in a range of cross-sectional sizes adapted to respectively receive wire of a thickness such as from 0.015 to 0.075 inches. Said wheel 102 is shown to be suitably secured by a lock nut 103. Said wheel 95 has annular grooves 96 corresponding to and diametrically mating with said grooves of said roller 102. The number of annular grooves here shown about said wheels 95 and 102 are for purpose of illustration only, and said wheels comprise the wire feeding means for the embodiment here presented.

Carried on the inner end of said shaft 98 is a gear member 107 adapted to mesh with and be driven by a like gear member 108 carried on the shaft 63 whereby said wheel members 95 and 102 rotate simultaneously in opposite directions.

Said way 100 is shown as a plate member held between retaining cross plate members 110 and 111 secured to the walls 23 and 28 with the purpose to provide on the order of 0.015 inches of vertical movement which is allowed for in the opening or passage 112 through which the shaft 98 passes. A spring 114 is shown seated between the upper end of the way 100 and the bearing member 60 to normally urge the way 100 downwardly to move and hold the wheel 102 out of a driving or wire feeding engagement with the wheel 95.

As shown in FIG. 1, a horizontal bar 115 is pivoted at 116 to said front wall 23 below the way 100 and carried thereon is an adjustable bolt like stop member 118. A second adjustable plate held bolt like stop member 120 is positioned below the bar 115. A coil spring 121 is seated between the lower end of the way 100 and the upper side edge portion of the bar 115. Carried on said front wall 23 adjacent the free end of said bar 115 is a means 123 to cause the wire feeding wheel 102 to be raised into wire feeding engagement with the wheel 95. Said means 123 is here shown as a hydraulic valve which when actuated is caused to have its piston 124 raise the bar 115 and thus raise said wheel 102.

The hydraulic valve 123 is in communication with the hydraulic pump 48 and the reservoir therein through a control member 122 as indicated in FIG. 1 and which as here used is well known in the art with respect to its electrical control of the solenoids **48*a* and 48*b* and the arrangement of hydraulic lines to provide communication between the ports A and B of said pump and the hydraulic valves 123 and the valves 183 and 185** to be described whereby upon demand hydraulic fluid will be supplied to said valves under line pressure.

The control device 31 is in circuit with said control member 122 whereby at the end of each spring forming cycle as pre-set, said device is wired to cause the hydraulic valve 123 to retract its piston and thus the feeding roller 102 drops out of engagement with the roller 95. This provides a millisecond pause and said device is also wired to cause at the same instant the valve 183, to be described, to cause a wire cutting tool to cut off the spring from the wire being fed, as will be described.

Figure 4:
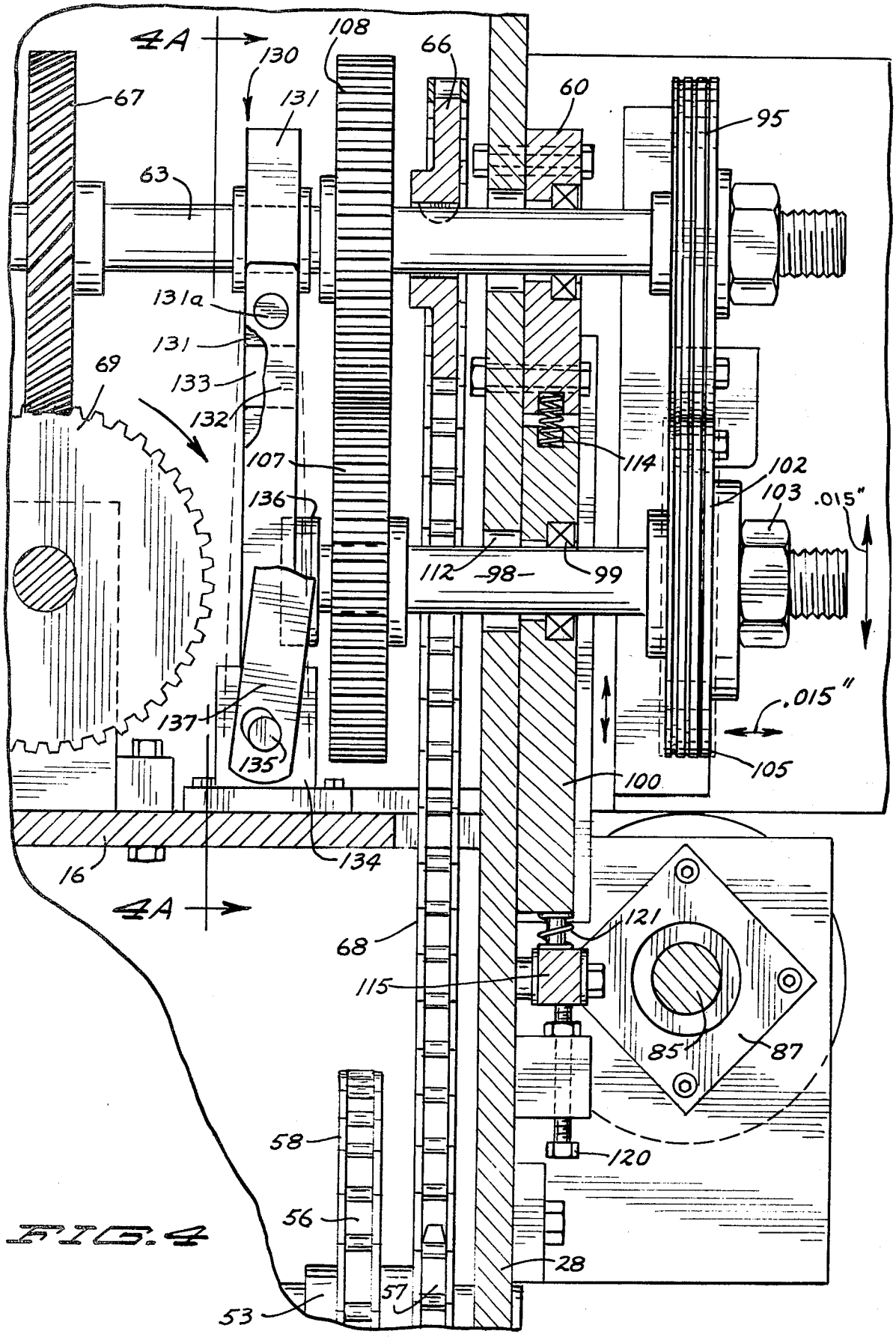
FIG. 4 is a view in vertical section taken on line 4—4 of FIG. 2 as indicated with portions thereof being broken away.
Figure 4A:
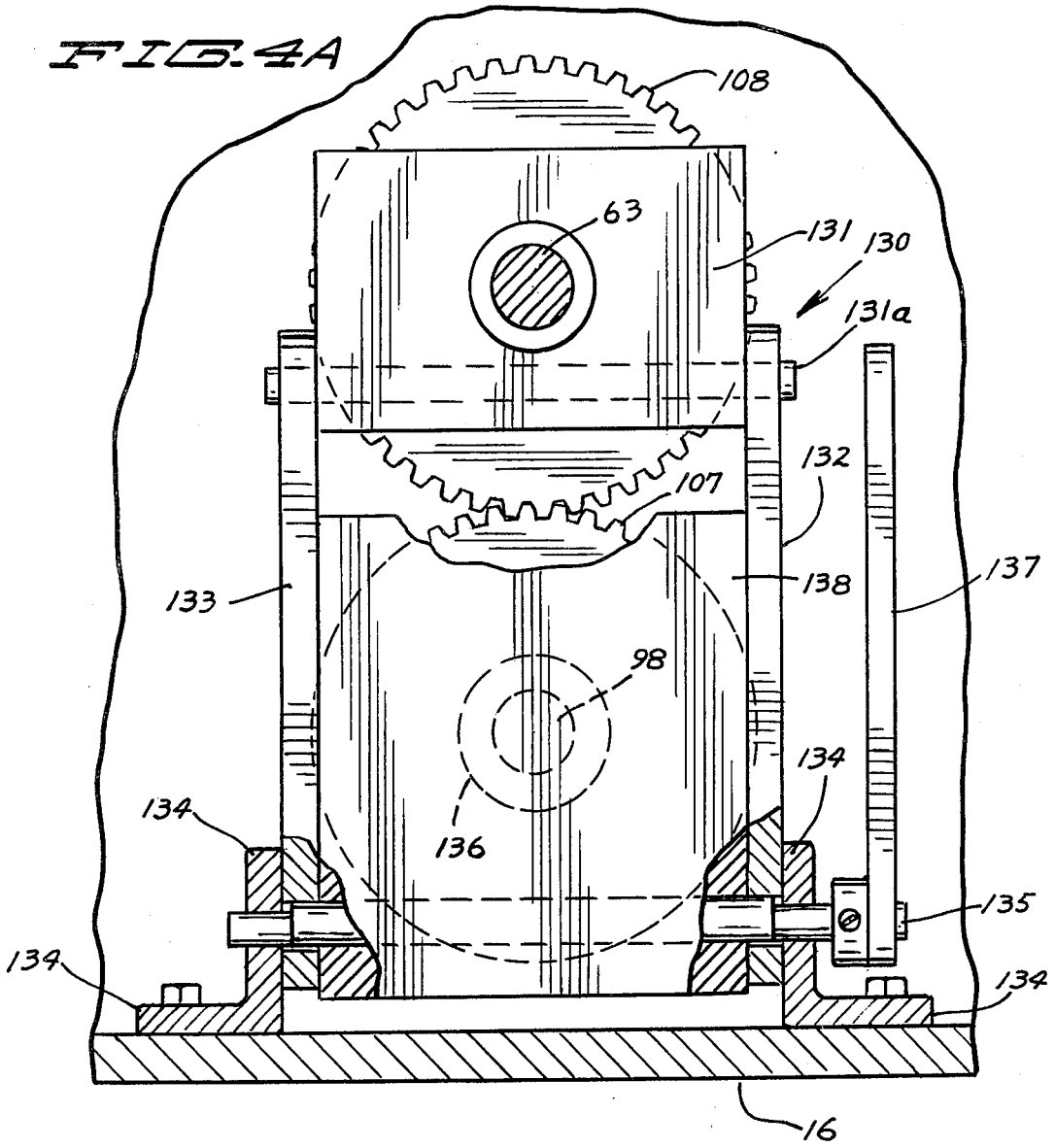
FIG. 4A is a view in partial vertical section taken on line 4A—4A of FIG. 4 as indicated.
Figure 7:
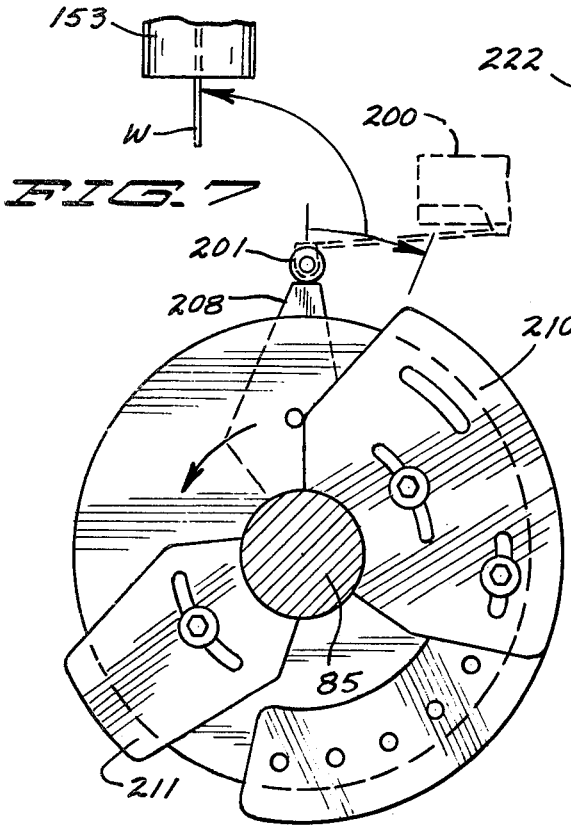
Figure 8:
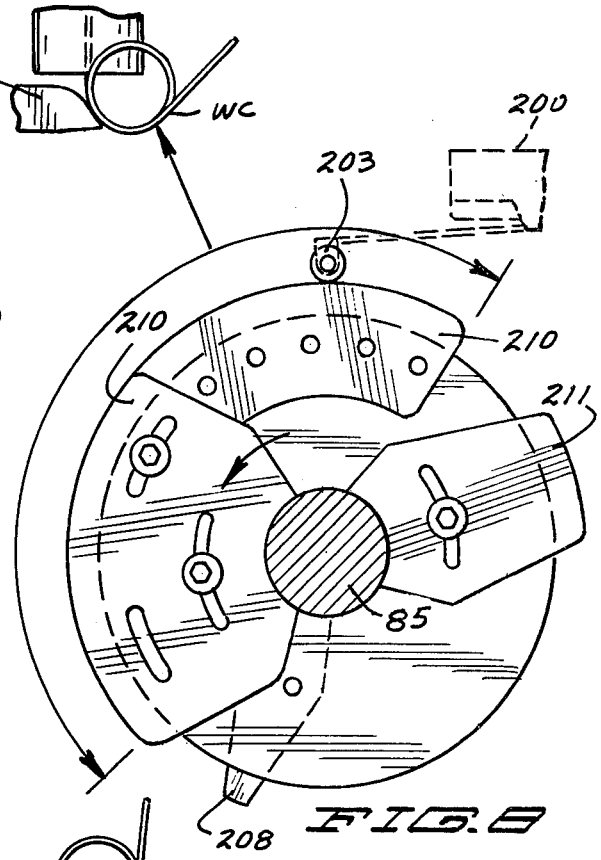
Figure 9:
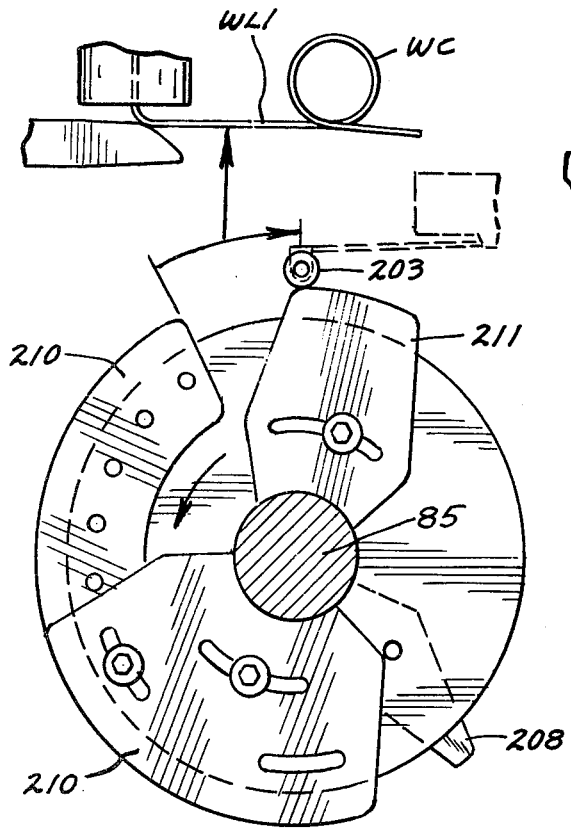
Figure 10:
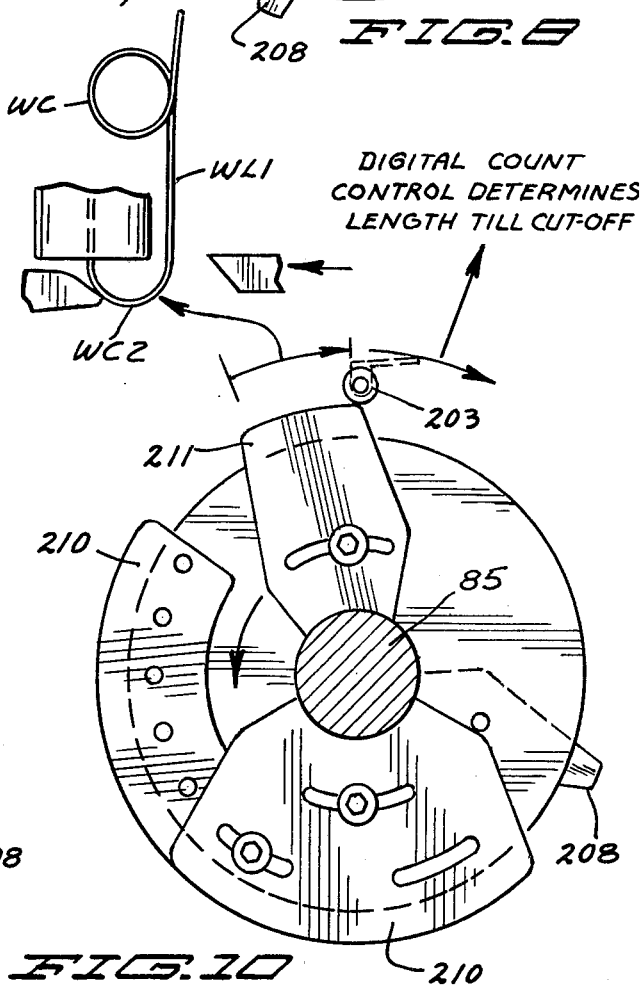
Figure 11:
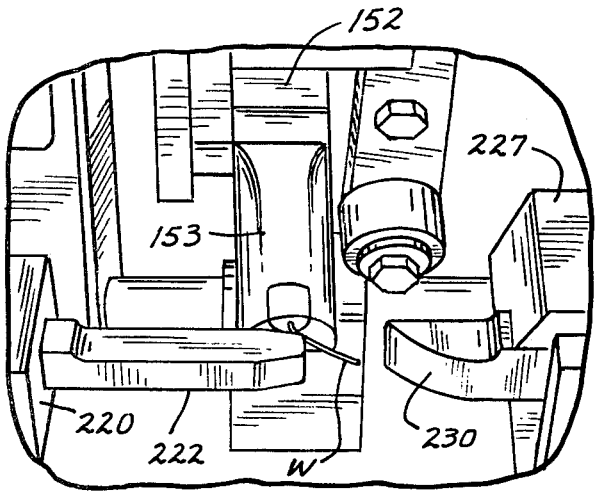
FIGS. 11–17 are fragmentary views in perspective which with respect to the FIGS. 7–10 immediately above described show several wire forming stages of wire forming elements.

Referring to FIGS. 4 and 4A, for the purpose of laterally biasing the wire fed by the feed rollers 95 and 102, a yoke member 130 is provided comprising a horizontal bar 131 through which the shaft 63 is journaled and a pair of spaced leg members 132 and 133 extend downwardly therefrom pivoted at **131*a*. Carried between said depending leg members is a plate member 138 and an offset shaft 135 in the form of a crank extending transversely through the free end of said plate member and said leg members adjacent the bottom thereof, said plate member being secured to the adjacent end of the shaft 98 by an end bearing cap member 136. An upstanding lever arm 137 is secured to an end of said crank shaft whereby rearward and forward motion of said lever arm swings said depending plate member 138 and moves therewith said shaft 98 axially on the order up to 0.015 inches which movement causes the grooves in the roller 102 to be offset diametrically somewhat from the corresponding grooves in the roller 95 and said respective grooves will be offset just sufficiently to bias slightly wire passing between a mating pair of said grooves whereupon when said wire passes outward of the quill 153**, to be described, the wire will have a tendency to curve in accordance with the biased pressure placed thereon.

Said encoder 36 and wire guiding block 39 are supported by a bracket 145 which carries thereon a spring loaded pivoted tension arm 146 to cause the wire W being fed to bear against the bottom edge of the wheel 38 sufficiently to cause the rotation of the wheel by the advancing movement of the wire.

Referring now to FIGS. 1, 3 and 5–6, carried on said wall 26 and extending therethrough supported by an appropriate bracket 150 is a wire guide 152 comprising a pair of facing blocks having transversely spaced passages **152*a*, 152*b* and 152*c* therethrough to accommodate the gage or width of different sized wire being fed and corresponding to and being aligned with the corresponding mating pairs of grooves 105*a*, 105*b* and 105*c* of said rollers 95 and 102. The outer end portions 152*a* and 152*b* of said block 152 to the right of wall 26 as seen in FIG. 1 are recessed as at 152*f* to receive as an insert therein a quill member 153 which has a passage 153*a* therethrough forming a continuation of one of the passages 152*a***, *b* or *c*. A quill is provided having a passage corresponding to each of the annular grooves of said rollers 95 and 102 and to said passages **152*a*, 152*b* and 152*c*** to be aligned therewith having a corresponding diameter.

Referring particularly to FIGS. 5, **5*a* and 6, each of the quills shown additional to the quill 153 and their respective passages are indicated by the same reference numeral with single and double primes added. The respective passages in the quills will be transversely positioned within each quill to be in alignment with a corresponding sized passage 152*a***, *b* or *c* in the guide block 152 and in the alignment with the corresponding passage **105*a***, *b* or *c* formed between the feeding rollers 95 and 102 by the mating of their respective annular grooves as indicated in FIG. 4. The expanded perspective view of FIG. **5*a* shows a relationship of the respective passages above described. Thus it is seen to accommodate a given wire size, the wire is merely disposed through the appropriate mating grooves or passages of the feeding rollers 95 and 102 and the wire will pass through a corresponding sized passage in the guide block 152 and a quill having a corresponding size passage therethrough is very simple disposed into position within the recess or chamber 152*f* as indicated in FIG. 5**. The same may be secured by a set screw or bolt not here shown.

Thus by a mere interchange of quills, the machine herein readily accommodates various sizes of wire without any other change being required to set up the machine for a particular wire size. The three passage sizes shown herein are for purpose of illustration only and not for purpose of limitation.

Though not here shown, a forming tool including an arbor may be mounted to form a continuous coil such as in forming an extension spring. This kind of forming tool is known in the art and is not here shown.

Secured to the upper portion of the outer side of said wall 26 with reference to FIG. 3 are a pair of spaced bearing members 160 and 161 in horizontal alignment having journaled therethrough a shaft 163. In aligned vertical spaced relation with said bearing members 160 and 161 are like bearing members 166 and 167 having journaled therethrough a shaft 169 in vertical alignment with said shaft 163. Said shafts 163 and 169 are journaled in their respective bearings to have axial or sliding movement therethrough. Appropriately journaled on said shafts for relative sliding or axial movement thereon is a tool mounting block member 170.

Secured to the respective ends of said shafts 163 and 169 and extending thereacross are block members 172 and 173. Said block members are further described as tool mounting block members and will be conveniently formed to have tools mounted thereon as by bolts or other appropriate securing members.

Upstanding from said block member 173 and the adjacent end portion of said shaft 163 is an upstanding plate member 174 having an upstanding post member 175. Upstanding from the left end portion of the tool mounting block 170 as seen in FIG. 3 is an upstanding post 176.

Retained by said posts 175 and 176 are resilient retraction means 170 here shown as a pair of tension return or retraction springs which normally retain tool holding block members 170 and 172 out of operating position in directions away from said quill 153. Said block member 170 is slidably moveable on said shafts 163 and 169 and said block member 172 is moved by movement of said shafts.

Mounted at the upper portion of wall 26 are a pair of hydraulic valves 183 and 185, each having ports A and B to respectively actuate their respective pistons 184 and 186.

An upstanding stop member 190 is mounted on the tool block member 170 to be engaged by the piston 184 to move said block member 170 to the left against the tension of the springs 180 into an operating position as will be described.

The plate member 174 is engaged by the piston 186 to move said shafts 163 and 169 axially against the tension of the springs 180 to move the tool mounting block 172 into an operating position with respect to the quill 153. Thus, it is seen that the block member 170 and the block member 172 have independent movement.

The ports of the valves 183 and 185 will be in circuit with and be connected to corresponding ports of the hydraulic pump 48 by means of the solenoid control or diverting member 122 in a known and customary manner as hereinabove indicated.

Carried by a fixed block member 195 mounted above said block member 160 and threaded therethrough is a stop member 196 to engage the block member 190.

Carried by said tool mounting block member 172 and threaded therethrough is an adjustable stop member 198 to engage the plate member 199 carried by the wire feeding block 152.

Referring to FIG. 1, carried by a bracket 200 are a pair of operating means 201 and 203 respectively shown here and referred to as spaced micro-switches. The switch 201 is in electrical circuit with the re-set circuit of the count control device 31. The switch 203 is in circuit with the control member 122 and through it with the hydraulic pump 48 for operation of the hydraulic valve 185. The specific wiring is a matter of circuit design and known in the art.

Secured onto said shaft 85 for operation of said switches 201 and 203 is a cam bearing hub 206 which carries cam lobe members thereon and for purpose of illustration herein, a cam lobe member 208 is mounted at one side of said hub to engage the switch 201 and cam lobe members 210 and 211 and are mounted at the other side of said hub to engage the switch member 203. It will be understood that various combinations or sizes of cam lobes as may be desired may be mounted onto said hub 206.

Springs, except for the straight leg portions thereof are formed by wire forming tools and as an example of the same, a tool holding member 220 is shown mounted onto the tool mounting block 172 and is carrying a forming tool or member 222 which is an elongated bar having its head portion **222*a* beveled to form a deflection surface or coiling point for engagement with the wire fed through the quill orifice 153*a*. The bevel is a matter of design which generally will vary as to each forming tool and determines the size of the wire coil formed. Reference is had to FIG. 1**.

Said block 170 is seen to have a cylindrical projection 225 integral therewith to form a tool mount and secured thereon is a tool holding member 227 secured as by a set screw and carries in this instance a wire cutting tool 230. The tool 230 is similar to the tool 222 with the exception that its head portion is beveled or formed to sever or cut a wire upon engagement in connection with the quill 153.

OPERATION

To commence the operation, the switch 46 is turned on to energize the motor 43. The switch 50 will be turned on for operation of the hydraulic pump 48. The switch 35 will energize the circuit which includes the count control device 31, the encoder 36, the hydraulic control member 122, the solenoids **48*a* and 48*b* and the microswitches 201 and 203**.

The wire W will come from a supply coil and will be fed through the block 39 and threaded through the guide members 42 and 152 and into and through the quill 153.

The count control device 31 is pre-set to sense and measure the length of the wire to be fed for each spring formed and, for example, upon a predetermination that a given spring shall be formed of 7 inches of wire, said count control device will be pre-set for a cyclical operation based upon increments of 7 inches of wire being fed and formed into a spring. Said encoder 36 will preset whereby, for example, each impulse imparted by it to the count control device 31 responsive to the rotation of the counting wheel 38 will represent 1 inch of wire passing said wheel.

Said switch button 35 will energize the count control device 31 and through it commences the operation of the encoder 36. The count control device is in circuit with the hydraulic pump through the control member 122 for operation of the hydraulic valves 123 and 183.

The motor 43 drives the main power shaft 63 by means of the chain 68 and shaft 63 in turn by a pair of bevel gears as described drives the shaft 70 and by means of the chain 75 drives the shaft 85. Thus, the feeding roller 95 is rotated and it in turn rotates its companion roller 102. At this point in time, the roller 102 is not in wire feeding or frictional engagement with the roller 95.

The device 31 upon being energized causes the hydraulic valve 123 to extend its piston 124 to raise the lever bar 115 and thus move the roller 102 into wire feeding engagement with the roller 95. This is a simultaneous action with the commencement of the counting of the length of wire being fed.

When a predetermined straight length of wire has been fed through the quill 153, the cam lobe 210 carried on the hub 206 will have been moved by rotation of the shaft 185, which is driven by the motor 43, to engage the micro-switch 203 which is in a circuit, as previously described, to actuate the hydraulic valve 85 to extend the piston 186 and slide the shafts 163 and 169 to position the tool mounting member 172 and the deflection or forming tool 222 thereon into an operating position with respect to the quill 153 and the end portion of the forming tool engaged by the wire fed through the quill will have a predetermined angle or curve of deflection thereon to provide a coiling point for the wire being formed into the size of coil desired and the coiling of the wire will continue for the length of time that said cam lobe 210 continues engagement with the microswitch 203.

When the cam lobe 210 drops from the micro-switch 203, the piston 186 will be retracted and the springs 180 will automatically return or retract the forming tool 222 to its normal non-operating position. At this point another straight leg portion will emerge from the quill until the cam lobe 211 engages the micro-switch 203 to again return the forming tool 222 to its operating position relative to the quill 153 to form an additional coil and when a desired length of wire has been fed corresponding to the predetermined length of wire to be formed into the spring, the counter control device 31 will have completed a cycle and will by a relay therein not here shown open the circuit running to the hydraulic valve 123 to drop the feeding roller 102 out of engagement with its upper companion roller 95 and thus the feeding of wire will cease. At this time the count control device by a relay in its circuitry, not here shown, will cause the hydraulic valve 183 through the control member 122 to move the cutting tool 230 relative to the quill 153 to cut off the end of the spring formed. There is a very small delay at this point on the order of ten milliseconds and the cam lobe 208 engages the micro-switch 201 causing the count control device to become re-set for a new cycle of operation.

The device 31 has a built in time delay at the end of each operating cycle for the length of time required for the cutting tool 230 to cut off the springs formed and thereafter for said counting device to become reset to commence a new cycle of operation. Thus the wire forming operation continues.

Figure 12:
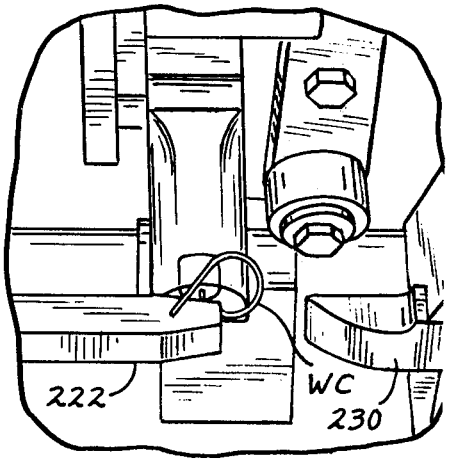
Figure 13:
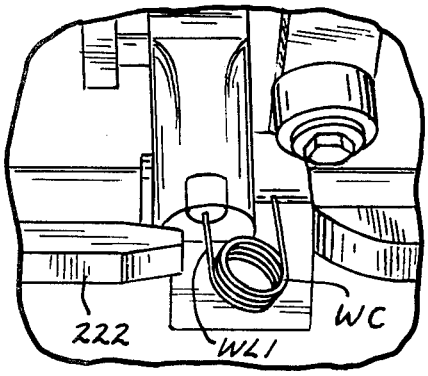
Figure 17:
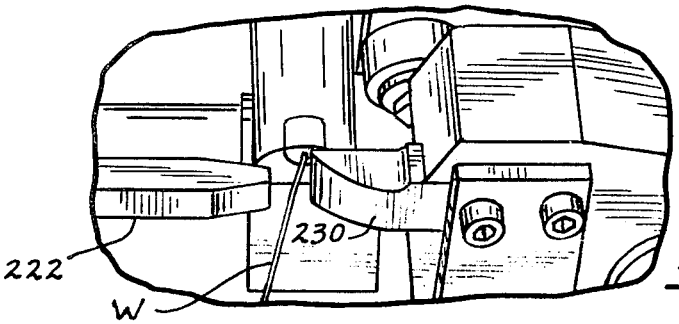

With particular reference to FIGS. 11–17 an illustration is given of a cycle of operation. The wire W is seen being fed through the orifice of the quill 153 and being deflected by the forming tool 222 to form the coil WC as seen in FIGS. 12 and 13. In FIG. 13 it will be noted that the forming tool 222 has been withdrawn with the disengagement of the cam lobe 210 from the micro-switch 203 to form a straight leg portion WL and with the engagement of the micro-switch 203 by the cam lobe 211 the forming tool 222 is again moved into operating position for engagement by the wire W to form a second coil or as in the case of the illustration here, it has formed only a partial coil WC2 and is then withdrawn to form a long straight leg WL2 and as indicated in FIG. 17, the cam lobe 211 will have moved out of engagement with the micro-switch 203 and at this point the preset length of wire for the spring has been sensed by the count control device 31 and it causes the valve 123 to release the feeding roller 102 and causes the valve 183 to move the cutting tool 230 to cut the wire at the point indicated in FIG. 17 and thereafter the next spring will be formed with the next cycle of operation and the same is repeated.

Referring to FIGS. 7–10, these FIGS. illustrate the positions of the cam lobes carried by the cam hub 206 to correspond to the various positions shown of the wire forming tool 222 and the wire cutting tool 230 in FIGS. 11–17.

Figure 14:
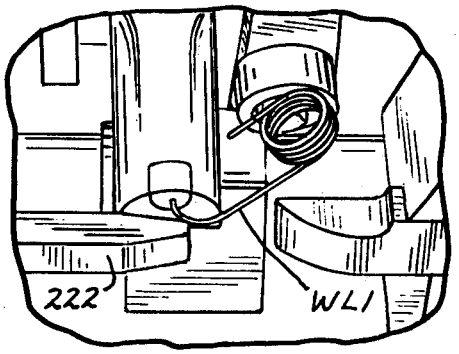
Figure 15:
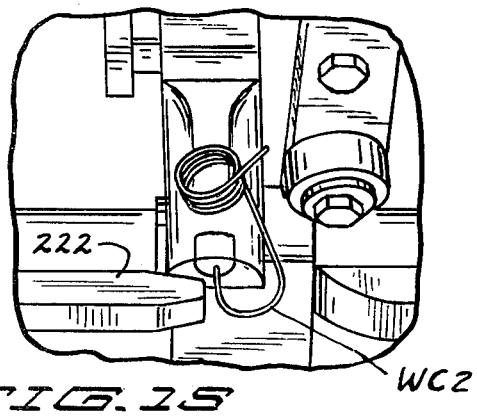
Figure 16:
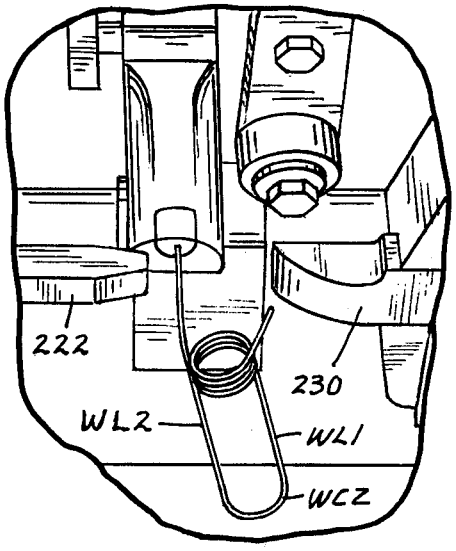

In FIG. 7, the cam lobe 208 has engaged the micro-switch 201 to reset the count control device 31 and in the interval between the disengagement of the cam lobe 208 from the micro-switch 201 and the engagement of the cam lobe 210 with the micro-switch 203 a straight length of wire W emerges from the quill 153. Thereafter, in FIG. 8, the cam lobe 210 engages the micro-switch 203 for the coiling of the wire as indicated in FIGS. 12–14. In FIG. 14, a straight leg WL1 is shown at the completion of the first coil and prior to the time that the cam lobe 211 engages the micro-switch 203 at which time the partial coil WC2 is formed referring to FIGS. 9 and 10 and thereafter a straight leg is formed as indicated by WL2 in FIG. 16 until the preset length of wire has been fed at which time the count control device 31 causes the release of the feeding roller 102 and causes the valve 183 to move the cutting tool 230 to cut off the end of the spring formed. Thereafter, with the engagement of the micro-switch 201 by the cam lobe 208, the counting device is reset and a new cycle of operation commences.

The FIGS. 7–10 and 11–17 are not precisely in phase but the operation is illustrated.

MODIFICATION

Figure 24:
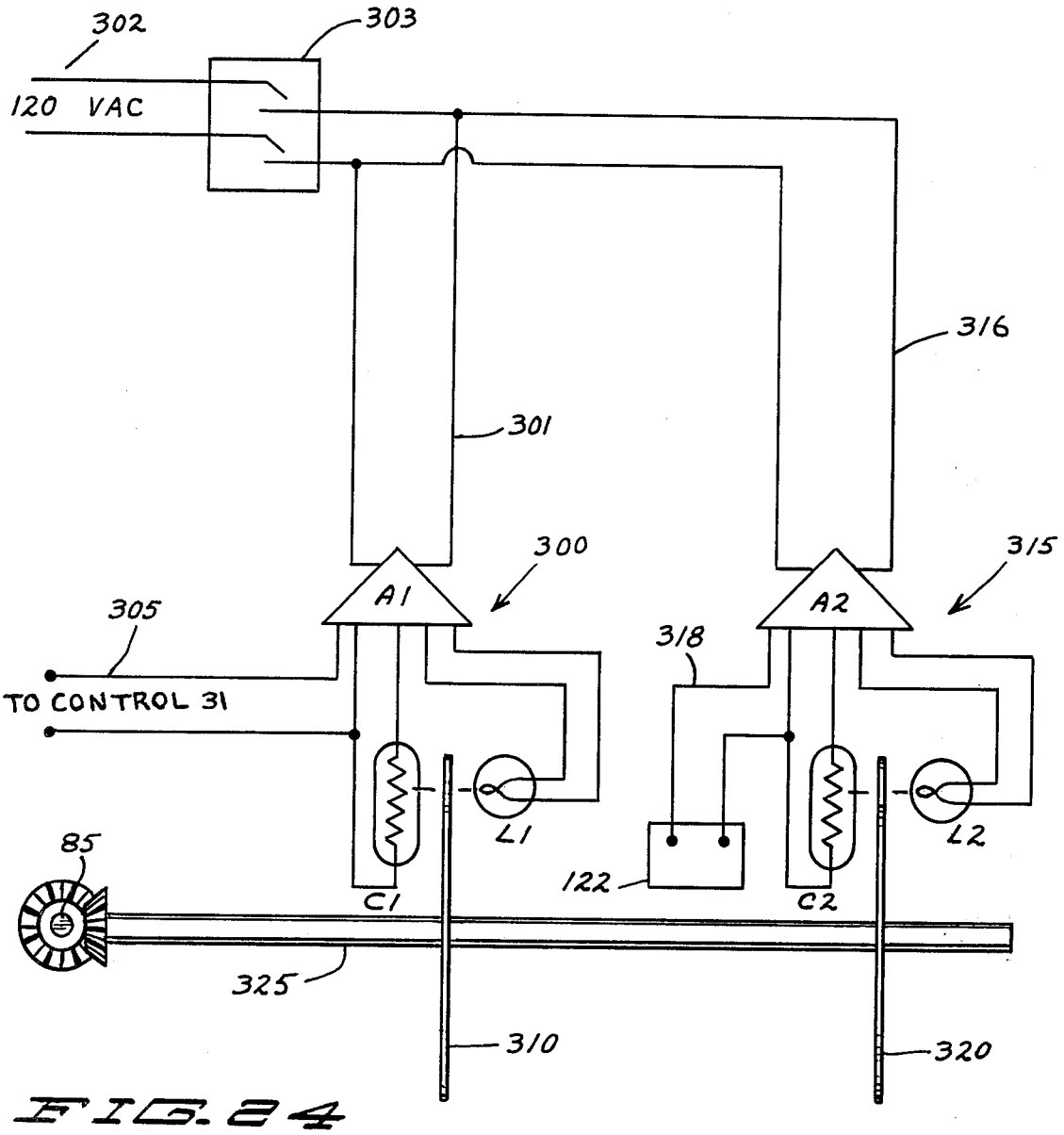
FIG. 24 is a schematic view of a modification.
Figure 24A:
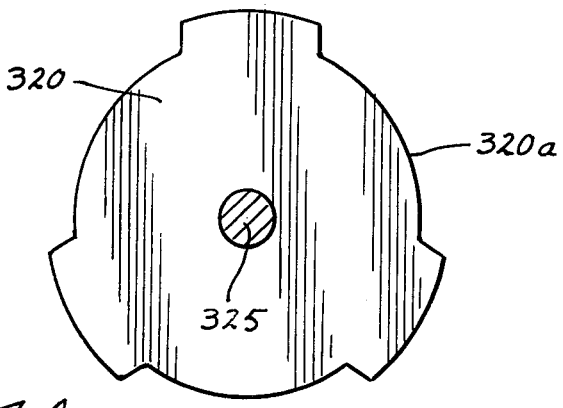
FIG. 24A is a view in elevation of a detail of what is shown in FIG. 24.

Referring to FIG. 24, a modification is shown in which the operating means in the form of the micro-switches 201 and 203 and the cam hub 206 and the cam lobes carried thereby are replaced by the use of light sensing means and a shield in connection therewith.

Replacing the micro-switch 201 is an assembly 300 consisting of a circuit 301 running to a source of current such as 302 and having a switch in connection therewith such as 303 which includes a light source L1, a light sensor or photocell C1 and a light sensor amplifier A1 which by means of lines 305 is electrically connected to the count control device 31 to reset the same. The internal wiring with respect to the connection of said assembly 300 therewith is known in the art and not here described.

Replacing the micro-switch 203 is an assembly 315 consisting of a circuit 316 running to a source of current such as 302 and including a light source L2, a light sensor C2 such as a photocell and a light sensor amplifier A2, which by means of lines 318 in the embodiment here illustrated through the central member 122 cause the hydraulic valve 185 to move the tool mounting block 172 and the tool held thereby into a wire forming operation in connection with a quill 153.

The shaft 85 by suitable gearing not here shown will drive a shaft 325 disposed at right angles thereto in operative relationship with said light sensing assemblies 300 and 315 and will carry thereon shields 310 and 320 which respectively are disposed between the light sources and light sensors of each of said assemblies. The shield 320 is shown as representative of both shields 320 and 310 and shown in connection therewith are peripheral recessed portions 320*a* to provide for the passage of light from lamp to light sensor and the extent of the recessed portion permitting passage of light substitutes for the length of the cam lobes as previously described during their period of engagement with their respective micro-switches.

This represents a great simplification over the structure replaced and more readily lends itself to varying specific control with respect to wire forming.

With reference to FIG. 3, a shallow chamber 326 is recessed between the walls 13 and 14 wherein the light sensing assembly above described as indicated may be very suitably mounted without further description.

MODIFICATION

In the fully mechanical operation of the invention herein, a cam actuating operation substitutes for the use of the count control device 31 and the cooperating hydraulic components.

Like reference numerals will indicate the elements above described and a prime will be added to indicate a modification of such elements.

Figure 18:
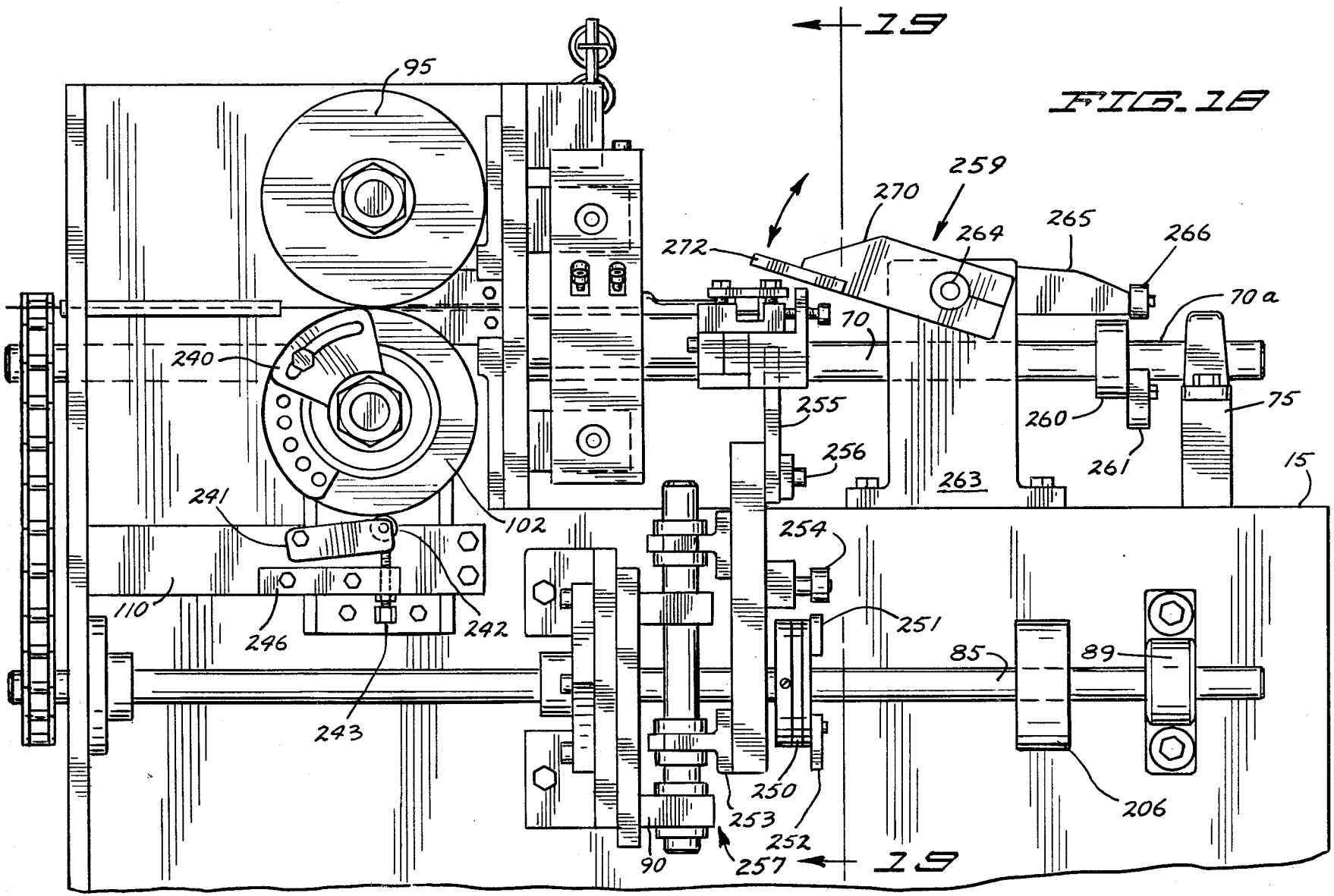
FIG. 18 is a view in side elevation showing a modification.
Figure 7B:
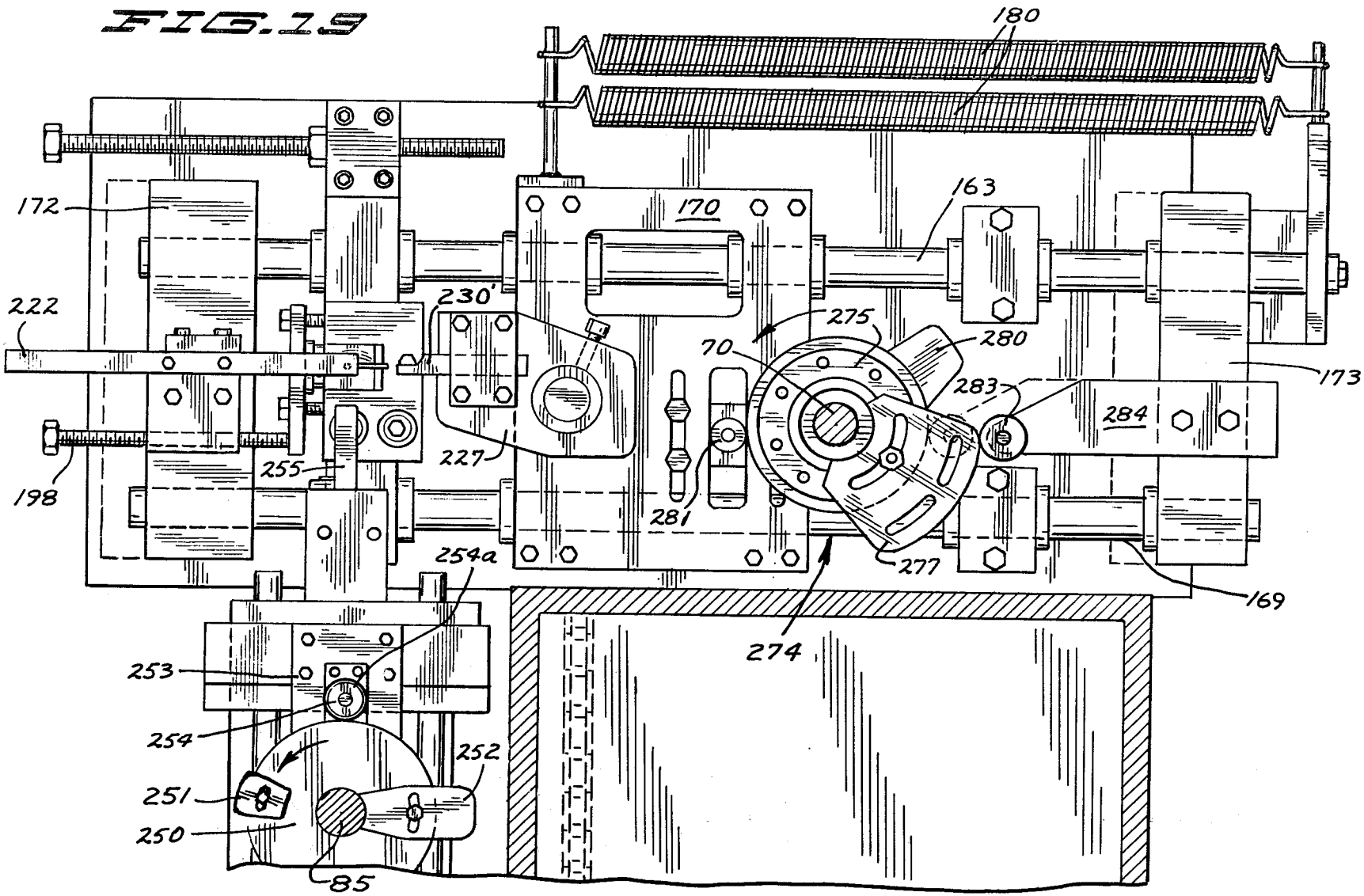

Referring to FIG. 18, the feeding roller 102 has in connection therewith a wire feeding control means 240 for causing engagement with said rollers 95 comprising a cam lobe member carried thereby projecting beyond the periphery thereof. Rotation of said roller causes said cam lobe member to engage an elevating arm 241 pivoted to the plate member 110 having a roller 242 at its free end, which end is adjustably elevated by the adjustable stop member 243 threaded up through a supporting member 246 which is also carried by the plate member 110.

It will be understood that the cam lobe member will be of a length to engage the roller 102 with the roller 95 for a sufficient time to feed the number of inches of wire required for each particular spring being formed. The feeding rollers are driven as long as the motor 43 is in operation but wire is fed only during the time the feeding roller or wheel 102 is in operating engagement with the feeding roller 95.

Mounted on the shaft 85 adjacent the bracket 90 is a cam hub 250 and carried on said cam hub will be cam lobes or cam lobe members such as 251 and 252 which will be appropriate for whatever particular form of spring is being made and comprise wire forming control means.

Said bracket 90 is shown having mounted thereon wire forming control means 257 comprising as here shown a tool mounting member 253 having a cam follower 254 which, by means of a sliding plate member 254*a* moves upwardly a forming tool or cutting tool 255, as the case may be, carried by mounting member 256. Thus said forming tool will be raised or moved upwardly to engage the wire being fed through the quill 163 to deflect and coil said wire in accordance with the length of time of engagement of said cam follower by the respective cam lobes such as said cam lobes 251 and 252.

Wire forming control means 259 are carried on said shaft portion 70*a* which adjacent it outer end carries a cam hub 260 having a cam lobe 261. Mounted on said top wall 15 adjacent said shaft 70 is an upstanding bracket 263 having pivoted thereon by a stub rod 264 having at one end an arm 265 carrying a cam follower 266 adapted to be engaged and raised by said cam lobe member 261. Also secured to said rod 264 is an arm 270 carrying a projecting wire cutting tool 272 which is shown cocked upwardly to be moved to cut a wire by action of the cam lobe 261.

Carried on said shaft 70 adjacent the shaft 169 is a tool actuating and control means 274 comprising a cam hub 275 carrying thereon, as shown here for purpose of illustration, cam lobes 277 and 280 respectively being positioned to engage the cam followers 281 and 283. The cam follower 281 is carried by the tool carrying member of block 170 and may be adjusted vertically. The cam follower 283 is carried by an arm 284 secured to the cross member 173 which connects the shafts 163 and 169. Thus said cam lobes 277 and 280 in view of the above described related elements respectively serve to actuate the tool carrying members 172 and 227. The tool 230' for purpose herein is indicated as being a forming tool. Thus it is seen that three wire forming tools are mounted with one wire cutting tool and the entire cooperative action for spring forming is the timing arrangement of the cam lobe members.

OPERATION

Figure 20:
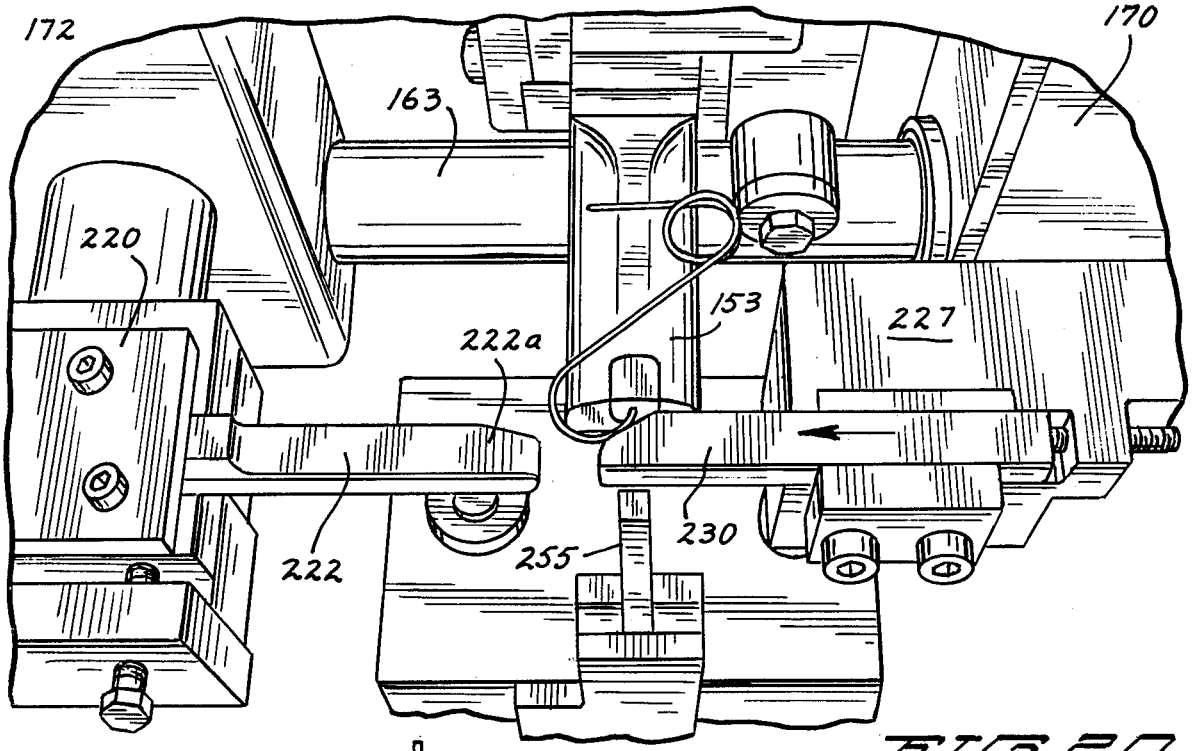
FIG. 20 is a broken view on an enlarged scale in perspective showing a wire forming operation.

It will be understood that each of the forming tools such as 222, 230' or 255 will have a deflective surfaced coiling point such as 222*a* in FIG. 20 inclined to produce the size of coil desired and that the position of the forming tools and the coiling tool such as 230 or 272 are interchangeable being positioned with respect to the form of the spring being desired.

In the mechanical operation, the shafts 63, 70 and 85 are driven while the motor 43 is operating and the cam lobes as above described are all positioned for continuous operation and for each type of spring formed, the straight leg and coils and the direction of coiling of each spring being determined by the placement and movement of the spring forming tools as actuated by the respective cam lobes engaging their respective followers.

Referring to FIG. 20, the tool members 222 and 230 are shown as deflection or forming tools and the tool member 255 will be regarded as a cutting tool.

No arbor is needed for coiling the wire to form the springs. The pitch or angle of direction of the forming tool as indicated at 222*a* determine the size of the coil together with its spacing relative to the quill and this is controlled by the cam lobes.

There is no dependence here with respect to feeding the wire by gears and this is the general practice in prior art spring forming machines. The use of gears for feeding wire fix limitations as to the length of a wire which can be fed with each cycle of operation and for each length of wire fed the gear must be returned to a start position. The machine as described herein does not have an incremental limited forward feeding operation but has a continuous forward movement feeding operation and the length of each spring is not determined by the length of a gear feeding the wire but by measuring the length of wire fed for each spring formed and cutting the same to separate the springs. The feeding is continuous and is merely interrupted by a few milliseconds of time for the purpose of cutting off a spring and starting the forming of a succeeding spring.

A further distinction which provides for a more efficient and faster output of springs by the machine herein lies in the use of prior art machines of an arbor to coil a wire thereabout and in coiling the wire about an arbor a reverse action is required to loosen the coil from the arbor which is an element of time required by a prior art machine not required by the machine herein.

Figure 21:
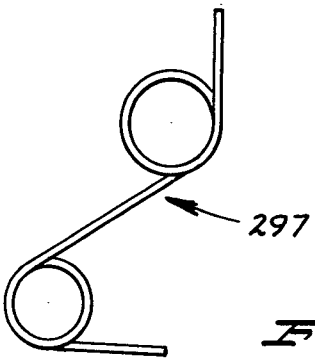
FIGS. 21–23 show several forms of springs.
Figure 22:
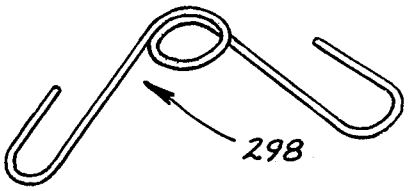
Figure 23:
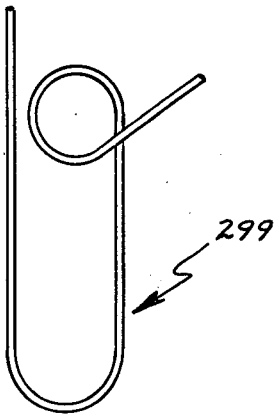

The FIGS. 21–23 illustrate forms of springs 297–299 which are formed in a continuous wire feeding operation and are here presented to show an example of various forms of which this machine is capable of producing.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

I claim:

1. A wire spring forming machine, having in combination a support structure, driving means carried by said support structure, a wire guide member carried by said support structure, endless rotary wire feeding means running continuously in a wire feeding direction being normally in a non-wire-feeding position, said first mentioned means driving said wire feeding means, an electronic control device predetermining the length of wire fed for each spring formed, a hydraulic valve in operative relationship with said wire feeding means and in circuit with a hydraulic pump, an control member providing communication between said pump and said valve, said control device being in circuit with said electric control member normally causing said valve to move said wire feeding means into wire feeding position, a wire cutting member in operative relationship with said wire guide member, a hydraulic valve in circuit with said pump and being in operative relationship with said wire cutting member, said electric control member providing communication between said valve and said hydraulic pump, said control device being in circuit with said electric control member to cause said first mentioned valve to release said wire feeding means to non-wire-feeding position and to actuate said second mentioned valve to cause said wire cutting member to cut the wire fed through said wire guide as each predetermined length of said wire is fed through said wire guide, means carried by said structure having a wire forming tool mounted thereon, a third hydraulic valve in circuit with said hydraulic pump, said electric control member providing communication between said third hydraulic valve and said pump, means having a cam hub mounted thereon, and being driven by said driving means, means carrying a pair of switches in operative relationship with said cam hub, a cam lobe carried on said hub engaging one of said switches, said one of said switches being in circuit with said control device to re-set the same, said lobe being arranged and constructed to engage said switch as each predetermined length of said wire is cut, the other of said switches being in circuit with said control member and said third mentioned valve, a cam lobe carried by said hub engaging said other of said switches to operate said third mentioned valve to engage said means having said wire forming tool mounted therein for engagement of said wire fed through said wire feed guide, and said last mentioned cam lobe being designed to have said tool engage said wire to provide a particular form of spring.

2. A wire spring forming machine, having in combination, a support structure including driving means, means pre-set to predetermine the length of wire to be fed for each spring formed, means engaged and actuated by wire fed electronically sensing the length of wire passing thereby, said last mentioned means converting the length of sensed wire fed passing thereby into increments of measure, said last means communicating said increments of measure to said first mentioned means, wire feeding means operated by said driving means and comprising a pair of oppositely driven rollers having tangential rim engagement advancing the wire passing therebetween, said wire feeding means being normally in non-wire-feeding engagement, an unyielding pressure means in operative relationship with said wire feeding means causing said rollers to be in wire feeding engagement, a wire guide receiving said wire fed by said wire feeding means, wire forming means in operative relationship with said wire guide, wire cutting means in operative relationship with said wire forming means and being normally in nonoperating position, and said pressure means and said wire cutting means being in operative relationship with said second mentioned means, whereby as each predetermined length of wire for a spring is fed, said second mentioned means automatically deactivates said pressure means to release said driving means to non-wire feeding position and activates said wire cutting means to cut each spring formed.

3. The structure of claim 2, wherein said second mentioned means comprises an electronic control device, said pressure means comprises a hydraulic valve in circuit with a hydraulic pump, an electric control member communicates between said pump and said valve and is in circuit with said electronic control device, a hydraulic valve in circuit with said hydraulic pump operating said wire cutting means, whereby said control device upon the feeding of each predetermined length of wire causes aid first mentioned hydraulic valve to release said wire feeding means from wire feeding engagement and causes said second mentioned hydraulic valve to actuate said wire cutting means, and including means causing said control device to become re-set after each length of wire cut off.

4. The structure set forth in claim 2, including a shaft mounted on said structure and driven by said driving means, a cam hub carried on said shaft, cam lobe carried at each side of said cam hub, a pair of switch members mounted adjacent said cam hub, one of said switches for engagement by one of said lobes being in circuit with said second mentioned means to re-set the same, said wire forming means including a hydraulic valve in circuit with a hydraulic pump, an electric control member controlling communication between said valve and said pump, and the other of said switches for engagement of the other of said lobes being in circuit with said electric control member.

5. The structure set forth in claim 2, wherein each of said rollers of said wire feeding means having a plurality of annular grooves thereabout transversely thereof and varying in cross-sectional dimension, corresponding grooves of said rollers having mating engagement, one of said rollers being mounted on a stub shaft carried on said support structure, said stub shaft having axial movement, adjusting means carried by said support structure adjacent one end of said stub shaft, and said last mentioned means being adjustable to move said one of said rollers axially relative to the other of said rollers to offset the mating engagement of said grooves of said rollers to apply a small increment of transverse bias against the wire being fed between said offset grooves.

6. The structure set forth in claim 2, wherein said wire feeding means comprises a pair of tangentially engaging rollers, means normally urging said rollers into a non-wire-engaging relationship, one of said rollers having a cam lobe mounted thereon extending beyond the periphery thereof, and a stop member adjacent said one of said rollers engaged by said cam lobe urging said one of said rollers into wire feeding engagement with the other of said rollers.

7. The structure set forth in claim 3, wherein said last mentioned means comprises a light source and a light sensing means having a shield therebetween controlling the passage of the light, the same being in circuit with said control device, and said shield being designed to close said circuit to cause said control device to become preset as each wire is formed and cut.

8. The structure set forth in claim 2, including a light sensing means and a light source having a shield therebetween and being in circuit with said second mentioned means, said shield being mounted in a timed relation with said wire cutting means passing light to cause said second mentioned means to become reset after each wire cutting operation, said wire forming means including a hydraulic valve in circuit with a hydraulic pump, an electric control member providing communication between said valve and said pump, a second light sensing means and a light source having a shield therebetween and being in circuit with said control member, said last mentioned shield being mounted in a timed relation to pass light to actuate said second mentioned circuit to cause said wire forming tool to engage and form said wire emerging from said quill, and means carried by said support member operating said first and second mentioned shields.

9. The structure of claim 2, wherein said driving means includes a single electric motor.

* * * * *